US010891817B2

(12) United States Patent
Matsumoto et al.

(10) Patent No.: US 10,891,817 B2
(45) Date of Patent: Jan. 12, 2021

(54) COIN HANDLING APPARATUS AND COIN HANDLING METHOD

(71) Applicant: GLORY LTD., Hyogo (JP)

(72) Inventors: Yasuhiro Matsumoto, Hyogo (JP); Masato Takeuchi, Hyogo (JP)

(73) Assignee: GLORY LTD., Hyogo (JP)

( * ) Notice: Subject to any disclaimer, the term of this patent is extended or adjusted under 35 U.S.C. 154(b) by 19 days.

(21) Appl. No.: 16/395,654

(22) Filed: Apr. 26, 2019

(65) Prior Publication Data

US 2019/0333306 A1 Oct. 31, 2019

(30) Foreign Application Priority Data

Apr. 27, 2018 (JP) ..... 2018-085984

(51) Int. Cl.

| | |
|---|---|
| ***G07F 19/00*** | (2006.01) |
| ***G07D 5/08*** | (2006.01) |
| ***G07D 1/02*** | (2006.01) |
| ***G07D 9/00*** | (2006.01) |
| ***G07G 1/00*** | (2006.01) |

(52) U.S. Cl.

CPC ..... *G07D 5/08* (2013.01); *G07D 1/02* (2013.01); *G07D 9/00* (2013.01); *G07G 1/0027* (2013.01); *G07D 2201/00* (2013.01); *G07D 2205/00* (2013.01)

(58) Field of Classification Search

CPC .. G07D 5/08; G07D 1/02; G07D 9/00; G07D 2201/00; G07D 2205/00; G07G 1/0027

USPC ..... 235/379, 375

See application file for complete search history.

(56) References Cited

U.S. PATENT DOCUMENTS

| | | | | |
|---|---|---|---|---|
| 3,147,839 A * | 9/1964 | White, Jr. | ..... | G07D 3/10 194/317 |
| 6,755,730 B2 * | 6/2004 | Geib | ..... | G07D 3/00 194/302 |

FOREIGN PATENT DOCUMENTS

| | | | |
|---|---|---|---|
| EP | 2045781 | A1 | 4/2009 |
| EP | 2 842 891 | A1 | 3/2015 |
| JP | 2015-49700 | A | 3/2015 |
| WO | 2008/099478 | A1 | 8/2008 |

OTHER PUBLICATIONS

European Search Report, European Patent Office, Application No. 19171037.5, dated Sep. 4, 2019, 9 pages.

* cited by examiner

*Primary Examiner* — Karl D Frech

(74) *Attorney, Agent, or Firm* — Greenblum & Bernstein, P.L.C.

(57) ABSTRACT

A coin handling apparatus comprises an inlet section that is provided on customer side of the coin handling apparatus and from which the coins are put in, a recognition unit that recognizes the coins put in from the inlet section, and a first ejection section that is provided on attendant side of the coin handling apparatus and to which the coins recognized as rejected coins by the recognition unit are ejected.

10 Claims, 4 Drawing Sheets

COIN HANDLING APPARATUS AND COIN HANDLING METHOD

CROSS REFERENCE TO RELATED APPLICATIONS

This application is entitled to (or claims) the benefit of Japanese Patent Application No. 2018-085984, filed on Apr. 27, 2018, the disclosure of which including the specification, drawings and abstract is incorporated herein by reference in its entirety.

TECHNICAL FIELD

The present invention relates to a coin handling apparatus and a coin handling method.

BACKGROUND ART

Conventionally, a coin handling apparatus such as a register change machine and a money changer is known as an apparatus to/from which coins are deposited/dispensed. PTL 1 discloses an invention relating to a coin handling apparatus in which, in a case where deposited coins are recognized as rejected coins by a recognition unit, the rejected coins are ejected to a coin outlet.

CITATION LIST

Patent Literature

PTL 1
Japanese Patent Application Laid-Open No. 2015-49700

SUMMARY OF INVENTION

Technical Problem

The above-described rejected coins ejected from the coin handling apparatus may include counterfeit coins and the like. If the rejected coins are ejected to the coin outlet, the counterfeit coins and the like may be put into circulation again. Therefore, it is desirable to appropriately handle the rejected coins in order to prevent the counterfeit coins and the like from being put into circulation again.

Accordingly, an object of the present invention is to provide a coin handling apparatus and a coin handling method that make it possible to appropriately handle the rejected coins.

Solution to Problem

A coin handling apparatus of the present invention is an apparatus that handles a coin, the apparatus comprising: an inlet section that is provided on a customer side of the coin handling apparatus and from which the coin is put in; a recognition unit that recognizes the coin put in from the inlet section; and a first ejection section that is provided on an attendant side of the coin handling apparatus and to which the coin recognized as a rejected coin by the recognition unit is ejected.

A coin handling method of the present invention comprises: putting in a coin from a customer side of a coin handling apparatus; recognizing whether the put-in coin is a rejected coin; and ejecting the coin recognized as the rejected coin to an attendant side of the coin handling apparatus.

Advantageous Effects of Invention

The coin handling apparatus and the coin handling method according to the present invention make it possible to appropriately handle the rejected coins.

DESCRIPTION OF EMBODIMENTS

An embodiment of the present invention is described below with reference to accompanying drawings.

Figure 1:
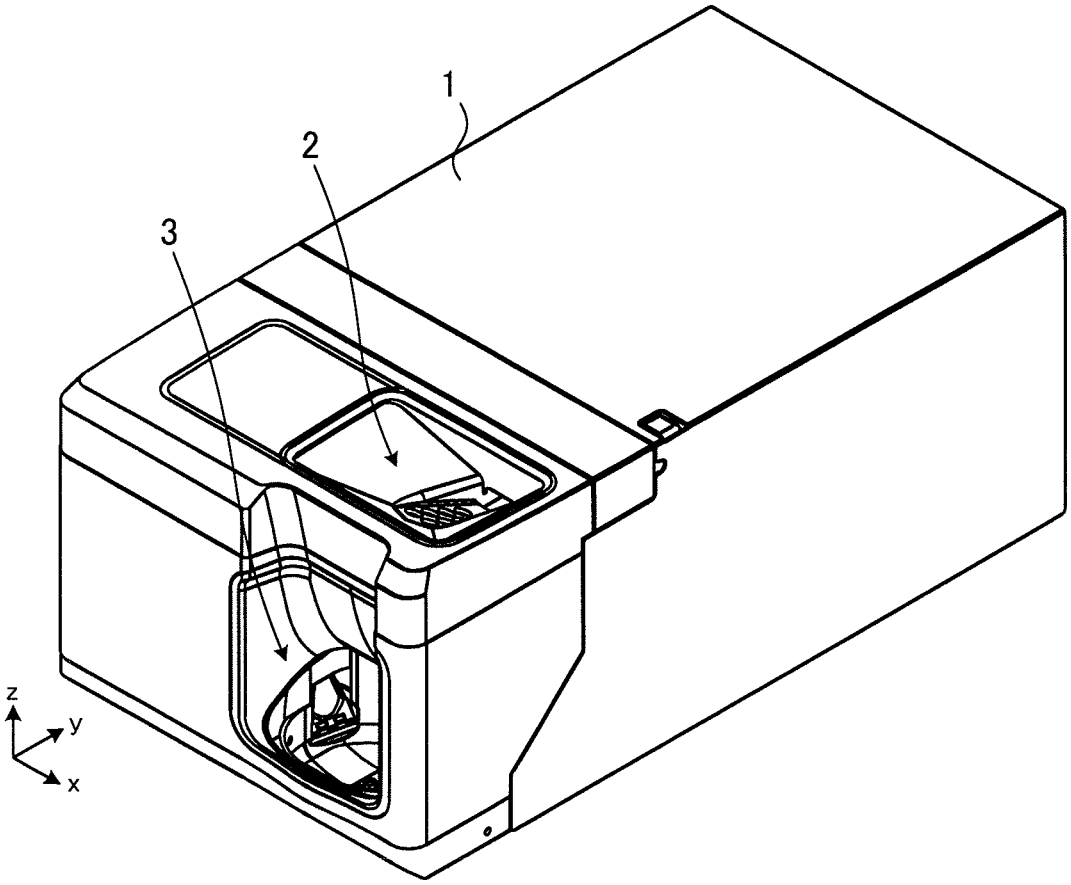
FIG. 1 is a perspective view illustrating an example of a coin handling apparatus according to an embodiment.

FIG. 1 is a perspective view illustrating an example of a coin handling apparatus 1 according to the present embodiment. As illustrated in FIG. 1, the coin handling apparatus 1 comprises an inlet 2 and an outlet 3. For example, the coin handling apparatus 1 stores coins paid at a cashier, or feeds out the stored coins as change. Further, the coin handling apparatus 1 constitutes a money changer, and dispenses the changed coins. Further, in a case where the coin handling apparatus 1 is an automatic teller machine, the coin handling apparatus 1 handles coins for deposition to an account of a customer or for dispensing of the coins from the account of the customer. In the following, triaxial coordinates as illustrated in FIG. 1 are set to the coin handling apparatus 1.

The inlet 2 is provided on a top surface (surface directed to +z direction) on front side (−y direction) of the apparatus. Coins to be deposited to the coin handling apparatus 1 are put into the inlet 2. The coins put into the inlet 2 are stored in the coin handling apparatus 1. Note that the inlet 2 may be provided not on the top surface but on a front surface of the coin handling apparatus 1 on the front side of the apparatus.

The outlet 3 is provided below the inlet 2 (−z side of apparatus) on the front side of the apparatus. The front side of the apparatus refers to one side of the apparatus that faces the customer operating the coin handling apparatus 1. Further, the front side of the apparatus refers to upstream side of a transport unit described below.

The coins stored in the coin handling apparatus 1 are ejected to the outlet 3. Further, a part of coins recognized as rejected coins by a recognition unit described below is ejected to the outlet 3 among the coins put into from the inlet 2.

The rejected coins refer to coins that are not handleable by the coin handling apparatus 1 and are unacceptable as deposited coins, or refer to something other than a coin. Examples of the rejected coins comprise counterfeit coins, possible counterfeit coins, coins of denominations that are not handleable, damaged coins, and a metal plate such as a button. The counterfeit coins are forged coins, for example, coins that are difficult to be discriminated in authenticity by naked eyes.

The rejected coins ejected to the outlet 3 include coins of denominations that are not handleable by the coin handling apparatus 1, damaged coins, and a metal plate.

The coin handling apparatus 1 comprises a collection section 20 (see FIG. 2 and FIG. 4) on a surface on side opposite to the outlet 3 (surface in +y direction). Here, the side opposite to the outlet 3 refers to rear side of the apparatus, and refers to the other side with respect to the above-described one side. Further, the side opposite to the outlet 3 refers to side facing an attendant of a store or the like in which the coin handling apparatus 1 is installed, and refers to downstream side of the transport unit described below.

The collection section 20 is disposed at a position inaccessible from the side facing the customer. For example, a front-side part and a rear-side part of the coin handling apparatus 1 are partitioned by a partition member such as a wall. This prevents the collection section 20 from being accessed from the customer side.

The coins recognized as the counterfeit coins or the coins recognized as the possible counterfeit coins are ejected to the collection section 20 among the coins recognized as the rejected coins by the recognition unit 13 described below. The coins ejected to the collection section 20 are collected by the attendant.

The collection section 20 is formed from, for example, a box having an open top surface. The collection section 20 is disposed outside a housing of the coin handling apparatus 1, and receives the coins ejected from a dispensing transport unit 17 described below.

Figure 2:
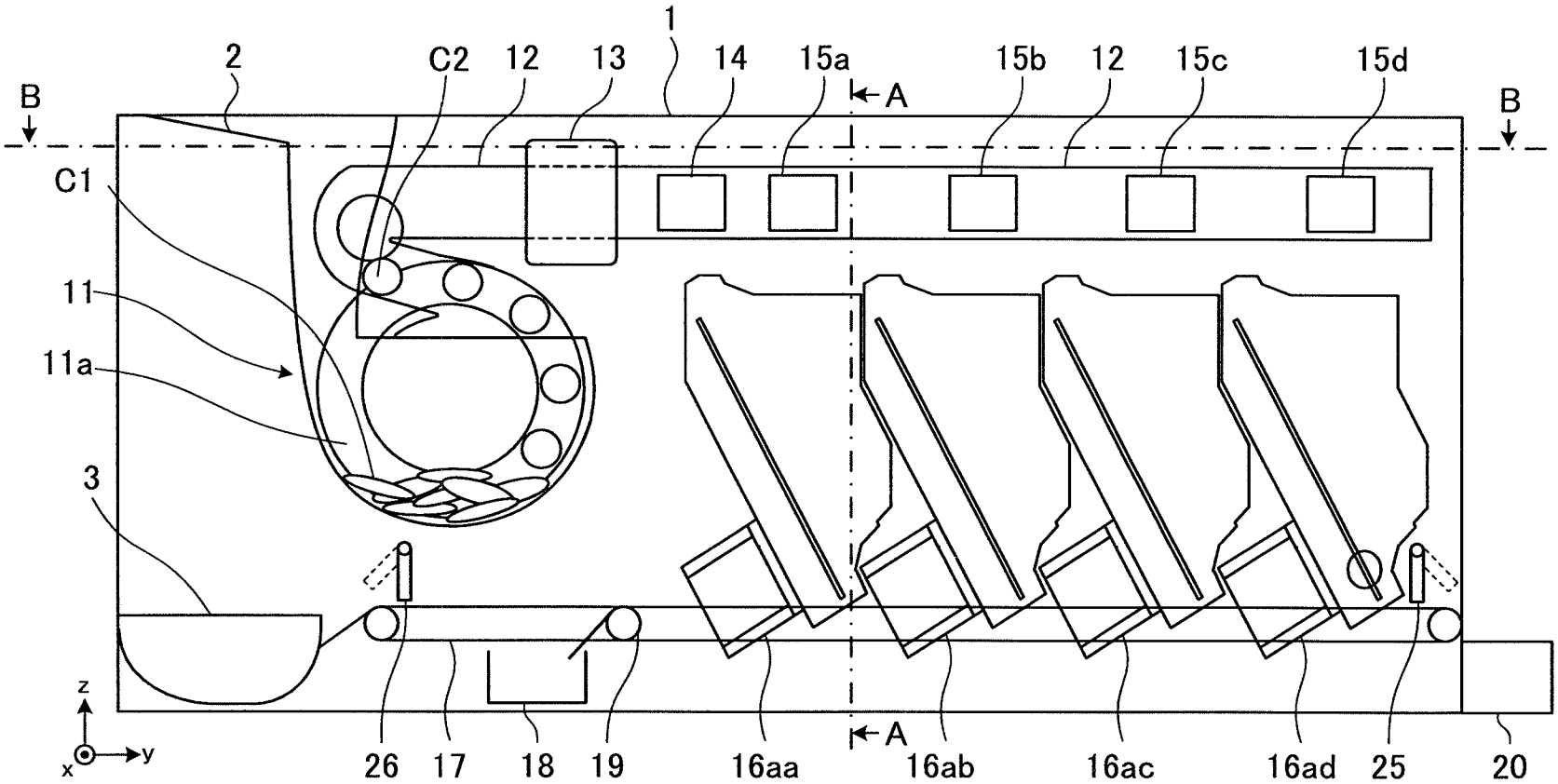
FIG. 2 is a cross-sectional schematic side view of the coin handling apparatus.
Figure 3:
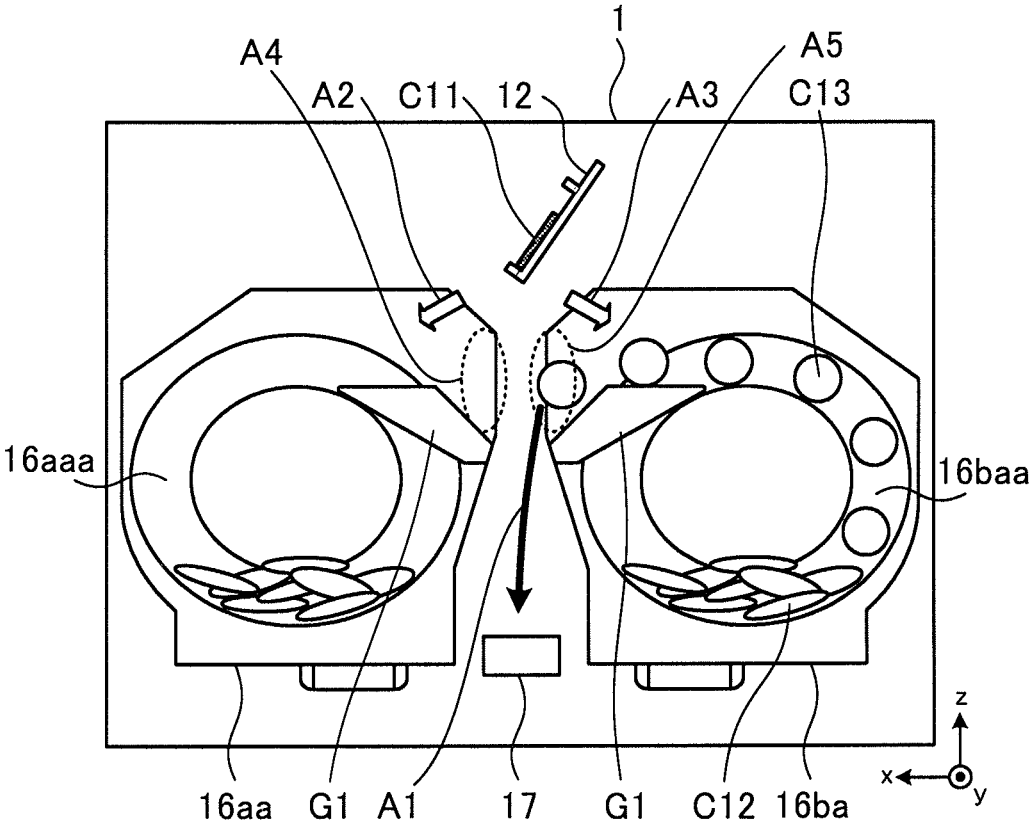
FIG. 3 is a cross-sectional view taken along arrow A-A in FIG. 2.
Figure 4:
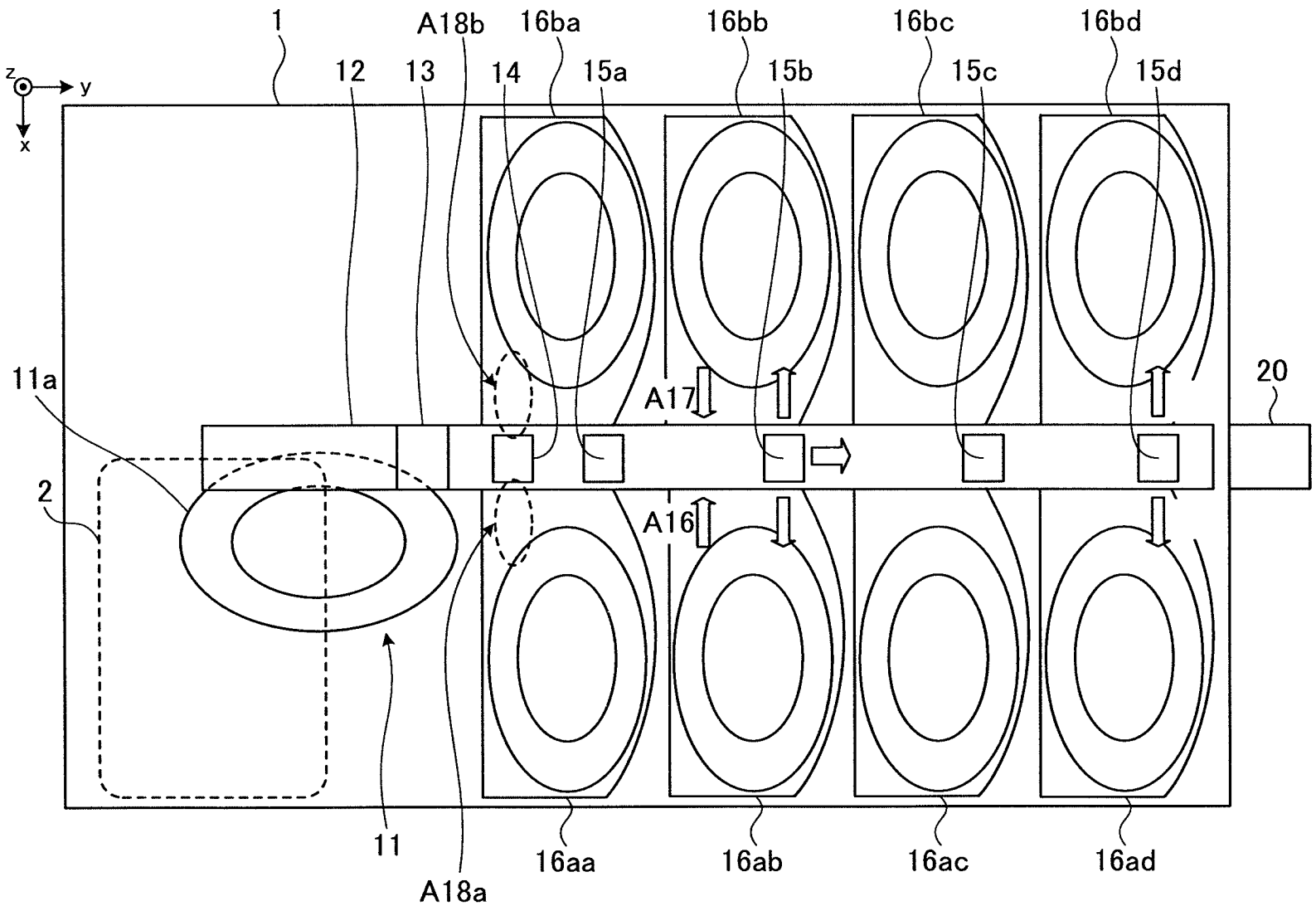
FIG. 4 is a cross-sectional view taken along arrow B-B in FIG. 2.

FIG. 2 is a cross-sectional schematic side view of the coin handling apparatus 1. The coin handling apparatus 1 in FIG. 2 is illustrated in a simplified manner in shape and the like from the coin handling apparatus 1 illustrated in FIG. 1. FIG. 3 is a cross-sectional view taken along arrow A-A in FIG. 2. In FIG. 3, illustration of a part of components illustrated in FIG. 2 is omitted. FIG. 4 is a cross-sectional view taken along arrow B-B in FIG. 2. Note that, in FIG. 1 to FIG. 4, the same components are denoted by the same reference numerals.

As illustrated in FIG. 2 to FIG. 4, the coin handling apparatus 1 comprises, in addition to the inlet 2 and the outlet 3, a reservation feeding unit 11, a transport unit 12, the recognition unit 13, coin diverters 14 and 15*a* to 15*d*, storage feeding units 16*aa* to 16*ad* and storage feeding units 16*ba* to 16*bd*, the dispensing transport unit 17, a storage unit 18, and the collection section 20. Further, the coin handling apparatus 1 comprises a control section (not illustrated) that controls the reservation feeding unit 11, the transport unit 12, the recognition unit 13, the coin diverters 14 and 15*a* to 15*d*, the storage feeding units 16*aa* to 16*ad* and the storage feeding units 16*ba* to 16*bd*, the dispensing transport unit 17, and the like.

The inlet 2 comprises a chute, and the put-in coins fall into a hopper of the reservation feeding unit 11 through the chute. The reservation feeding unit 11 temporarily reserves the coins put into the inlet 2. A coin C1 illustrated in FIG. 2 is a coin temporarily reserved in the hopper of the reservation feeding unit 11.

The reservation feeding unit 11 comprises a tilting disk 11*a*. The tilting disk 11*a* forms, together with the hopper, a space storing the coins. The tilting disk 11*a* comprises a protrusion (not illustrated) that catches the coin, on a front surface. The reservation feeding unit 11 rotates the tilting disk 11*a* (for example, rotates tilting disk 11*a* in counterclockwise direction in figure) to catch the temporarily-reserved coin C1 by the protrusion on the front surface, and picks up the coin C1. The reservation feeding unit 11 then feeds out the coin C1 that has been picked up by the tilting disk 11*a*, to the transport unit 12. A coin C2 illustrated in FIG. 2 is a coin to be fed out to the transport unit 12.

The transport unit 12 is provided just below the top surface of the coin handling apparatus 1. Further, the transport unit 12 is provided at substantially center in an x-axis direction as viewed from the front surface or a rear surface of the apparatus (see FIG. 3 and FIG. 4).

The transport unit 12 extends from the front side to the rear side of the apparatus. The transport unit 12 transports the coins fed out from the reservation feeding unit 11 from the front side to the rear side of the apparatus. A common technology that transports the coins by, for example, a transport belt can be used for the transport unit 12.

The recognition unit 13 is provided above the transport unit 12 on the downstream of the reservation feeding unit 11 and on the upstream of the coin diverters 14 and 15*a* to 15*d*. The recognition unit 13 recognizes the coins fed out from the reservation feeding unit 11. For example, the recognition unit 13 comprises various kinds of sensors such as a magnetic sensor, and recognizes denominations of the coins transported by the transport unit 12, whether the coins transported by the transport unit 12 are rejected coins (for example, counterfeit coins), and the like.

The coin diverter 14 diverts the coins transported by the transport unit 12 to two directions. For example, the coin diverter 14 diverts the coins transported by the transport unit 12 to the downstream side of the transport unit 12 (+y-axis direction) or the dispensing transport unit 17.

The coin diverter 14 diverts the coins transported by the transport unit 12 based on a result of the recognition by the recognition unit 13. For example, the coin diverter 14 diverts the coins recognized as the rejected coins by the recognition unit 13, to the dispensing transport unit 17.

Further, the coin diverter 14 diverts the coins other than the coins recognized as the rejected coins by the recognition unit 13, to the downstream side of the transport unit 12.

The coin diverters 15*a* to 15*c* divert the coins transported by the transport unit 12 to three directions. For example, the coin diverters 15*a* to 15*c* divert the coins transported by the transport unit 12, to the downstream side (+y-axis direction) of the transport unit 12, the storage feeding units 16*aa* to 16*ac*, or the storage feeding units 16*ba* to 16*bc* (see FIG. 3 and FIG. 4). The storage feeding units 16*ba* to 16*bc* are provided on the opposite side of the transport unit 12 from the storage feeding units 16*aa* to 16*ac*.

Further, the coin diverter 15*d* diverts the coins transported by the transport unit 12 to two directions. The coin diverter 15*d* diverts the coins transported by the transport unit 12 to the storage feeding unit 16*ad* or the storage feeding unit 16*bd* (see FIG. 3 and FIG. 4). The storage feeding unit 16*bd* is provided on the opposite side of the transport unit 12 from the storage feeding unit 16*ad*.

The coin diverters 15*a* to 15*d* divert the coins transported by the transport unit 12 to the directions based on the result of the recognition by the recognition unit 13. For example, the coin diverter 15*a* diverts the coins recognized as a first denomination by the recognition unit 13, to the storage feeding unit 16*aa* (see arrow A2 in FIG. 3). The coin diverter 15*a* further diverts the coins recognized as a second denomination by the recognition unit 13, to the storage feeding unit 16*ba* (see arrow A3 in FIG. 3) that is provided on the opposite side of the transport unit 12 from the storage feeding unit 16*aa*. The coin diverter 15*a* further diverts the coins recognized as a denomination other than the first denomination and the second denomination by the recognition unit 13, to the transport downstream side (+y-axis direction in FIG. 3).

The coin diverter 15*b* diverts the coins recognized as a third denomination by the recognition unit 13, to the storage feeding unit 16*ab*. The coin diverter 15*b* further diverts the coins recognized as a fourth denomination by the recognition unit 13, to the storage feeding unit 16*bb* that is provided on the opposite side of the transport unit 12 from the storage feeding unit 16*ab*. The coin diverter 15*b* further diverts the coins recognized as a denomination other than the first to fourth denominations by the recognition unit 13, to the transport downstream side.

The coin diverter 15*c* also diverts the coins transported by the transport unit 12 to three directions, in a manner similar to the coin diverters 15*a* and 15*b*. As for the coin diverter 15*d*, the downstream of the transport unit 12 does not exist. Therefore, the coin diverter 15*d* diverts the coins to two directions. For example, the coin diverter 15*d* diverts the coins transported by the transport unit 12, to the storage feeding unit 16*ad* or the storage feeding unit 16*bd* that is provided on the opposite side of the transport unit 12 from the storage feeding unit 16*ad*.

The storage feeding units 16*aa* to 16*ad* and the storage feeding units 16*ba* to 16*bd* store the coins transported by the transport unit 12 in respective hoppers. As described above, the coins transported by the transport unit 12 are sorted for each denomination by the coin diverters 15*a* to 15*d* based on the result of the recognition by the recognition unit 13. As a result, the storage feeding units 16*aa* to 16*ad* can store the coins of different denominations. In the present embodiment, the coin handling apparatus 1 can sort and store the coins of eight denominations at maximum.

At the time of dispensing, each of the storage feeding units 16*aa* to 16*ad* and the storage feeding units 16*ba* to 16*bd* feeds out the stored coins to the dispensing transport unit 17. Each of the storage feeding units 16*aa* to 16*ad* and the storage feeding units 16*ba* to 16*bd* comprise a tilting disk including a protrusion that catches a coin, on a front surface. Each of the storage feeding units 16*aa* to 16*ad* and the storage feeding units 16*ba* to 16*bd* rotates the corresponding tilting disk to catch the coin by the protrusion on the front surface, and picks up the coin. Each of the storage feeding units 16*aa* to 16*ad* and the storage feeding units 16*ba* to 16*bd* feeds out the coin picked up by the corresponding tilting disk from a feeding outlet, and drops the coin onto the dispensing transport unit 17 (for example, see arrow A1 in FIG. 3).

The dispensing transport unit 17 is provided below the transport unit 12 and on a bottom surface of the coin handling apparatus 1. The dispensing transport unit 17 extends from the front side to the rear side of the apparatus. The rejected coins diverted by the coin diverter 14 fall onto the dispensing transport unit 17. Further, the coins fed out from the storage feeding units 16*aa* to 16*ad* and the storage feeding units 16*ba* to 16*bd* fall onto the dispensing transport unit 17.

The dispensing transport unit 17 transports the coins fed out from the storage feeding units 16*aa* to 16*ad* and the storage feeding units 16*ba* to 16*bd* to the outlet 3. The dispensing transport unit 17 comprises, for example, a transport belt, and transports the coin fallen onto the dispensing transport unit 17 to the outlet 3.

Further, the dispensing transport unit 17 transports, among the rejected coins diverted by the coin diverter 14, the coins recognized as the counterfeit coins and the coins recognized as possible counterfeit coins by the recognition unit 13, to the collection section 20.

The dispensing transport unit 17 comprises a first stopper 25 near the collection section 20, and a second stopper 26 near the outlet 3. The first stopper 25 prevents the coins fallen onto the dispensing transport unit 17 from rolling and being discharged from the collection section 20. Further, the second stopper 26 prevents the coins fallen onto the dispensing transport unit 17 from rolling and being discharged from the outlet 3. This makes it possible to prevent the coins to be ejected to the collection section 20 from being discharged to the outlet 3 and to prevent the coins to be ejected to the outlet 3 from being discharged to the collection section 20.

The first stopper 25 is made of a plate member and is vertically disposed. The first stopper 25 is configured so as to be rotatable rearward about a horizontal rotating shaft provided at an upper end thereof. The second stopper 26 is made of a plate member, and is vertically disposed. The second stopper 26 is configured so as to be rotatable forward about a horizontal rotating shaft provided at an upper end thereof.

The first stopper 25 and the second stopper 26 are configured in the above-described manner, which causes the coins rolling on the dispensing transport unit 17 to collide with the first stopper 25 or the second stopper 26 and to fall over. Accordingly, the first stopper 25 and the second stopper 26 can prevent the coins from being discharged to the collection section 20 and the outlet 3, respectively.

Further, when the dispensing transport unit 17 transports the coins to the collection section 20, the first stopper 25 is pushed by the coins on the dispensing transport unit 17 and is rotated rearward. This enables the coins to pass through a clearance between a lower end part of the first stopper 25 and the dispensing transport unit 17.

Further, when the dispensing transport unit 17 transports the coins to the outlet 3, the second stopper 26 is pushed by the coins on the dispensing transport unit 17 and is rotated forward. This enables the coins to pass through a clearance between a lower end part of the second stopper 26 and the dispensing transport unit 17.

In addition, the first stopper 25 and the second stopper 26 each may be made of a material such as a sheet-shaped synthetic resin. In this case, respective upper end parts of the first stopper 25 and the second stopper 26 are hanged from predetermined members, and the first stopper 25 and the second stopper 26 are accordingly configured like a curtain provided between the collection section 20 and the dispensing transport unit 17 and a curtain provided between the outlet 3 and the dispensing transport unit 17, respectively.

Further, each of the first stopper 25 and the second stopper 26 is not limited to such a configuration, and may have a configuration sliding in a vertical direction.

The storage unit 18 is a storage apparatus that receives and stores a part of the coins transported by the dispensing transport unit 17. The coins to be stored in the storage unit 18 are not particularly limited, and for example, may be appropriately set by the attendant. The coins stored in the storage unit 18 are collected through drawn-out of the storage unit 18 from a predetermined direction of the coin handling apparatus 1.

As illustrated in FIG. 3, the coin handling apparatus 1 comprises the storage feeding unit 16*ba*. The storage feeding unit 16*ba* is provided on the opposite side of the transport unit 12 from the storage feeding unit 16*aa*.

FIG. 3 illustrates a coin C11 transported by the transport unit 12. A transport path of the transport unit 12 transporting the coin C11 is tilted as illustrated in FIG. 3.

As described above, the coin C11 transported by the transport unit 12 is diverted to the predetermined transport direction by the coin diverter 15*a* (see FIG. 2), based on the result of the recognition by the recognition unit 13.

For example, in a case where the coin C11 is of a denomination to be stored in the storage feeding unit 16*aa*, the coin C11 is diverted to a direction illustrated by the arrow A2. The coin C11 diverted to the direction of the arrow A2 is stored in the storage feeding unit 16*aa*. Further, in a case where the coin C11 is of a denomination to be stored in the storage feeding unit 16*ba*, the coin C11 is diverted to a direction illustrated by the arrow A3. The coin C11 diverted to the direction of the arrow A3 is stored in the storage feeding unit 16*ba*.

The storage feeding unit 16*aa* comprises the hopper and a tilting disk 16*aaa*. The tilting disk 16*aaa* forms, together with the hopper, a space storing coins. The tilting disk 16*aaa* is rotated in a clockwise direction in the figure, picks up coins stored in the hopper, and feeds out the coins to the feeding outlet at the time of dispensing.

The storage feeding unit 16*ba* comprises the hopper and a tilting disk 16*baa*. The tilting disk 16*baa* forms, together with the hopper, a space storing coins. The tilting disk 16*baa* is rotated in a counterclockwise direction in the figure, picks up coins stored in the hopper, and feeds out the coins to the feeding outlet at the time of dispensing.

A coin C12 illustrated in FIG. 3 is a coin stored in the hopper of the storage feeding unit 16*ba*. A coin C13 illustrated in FIG. 3 is a coin to be fed out from the storage feeding unit 16*ba*. The coin C13 is caught by the protrusion (not illustrated) of the tilting disk 16*baa* provided in the storage feeding unit 16*ba*, and is picked up. Further, the coin C13 gets on an upper end of a plate-like guide G1, is separated from the tilting disk 16*baa*, and falls onto the dispensing transport unit 17 as illustrated by the arrow A1 in FIG. 3. Note that dashed frames A4 and A5 in FIG. 3 indicate positions of the respective feeding outlets to which the coins are fed out.

In the following, the storage feeding units 16*aa* to 16*ad* that are located on right side as viewed from the front side of the apparatus. (−y-axis direction) are referred to as right storage feeding units 16*aa* to 16*ad* in some cases. Further, the storage feeding units 16*ba* to 16*bd* that are located on left side as viewed from the front side of the apparatus are referred to as left storage feeding units 16*ba* to 16*bd* in some cases.

The storage feeding units 16*aa* to 16*ad* and 16*ba* to 16*bd* each feed out the stored coins at the time of dispensing. For example, the storage feeding units 16*ab* and 16*bb* each feed out the stored coins at positions of arrows A16 and A17 (see positions of feeding outlets illustrated by dashed frames A4 and A5 in FIG. 3). For example, the fed coins fall onto the dispensing transport unit 17 as illustrated by the arrow A1 in FIG. 3 and are dispensed to the outlet 3.

Dashed frames A18*a* and A18*b* in FIG. 4 indicate the positions of the coin feeding outlets of the storage feeding units 16*aa* and 16*ba*. The feeding outlets illustrated by the dashed frames A18*a* and A18*b* respectively correspond to the feeding outlets illustrated by the dashed frames A4 and A5 in FIG. 3. Each of the storage feeding units 16*ab* to 16*ad* and 16*bb* to 16*bd* also comprises the feeding outlet at a position similar to the storage feeding units 16*aa* and 16*ba*. The storage feeding units 16*ab* to 16*ad* and 16*bb* to 16*bd* are arranged such that the feeding outlets of the storage feeding units 16*ab* to 16*ad* are provided on the opposite side of the transport unit 12 from the feeding outlets of the storage feeding units 16*bb* to 16*bd*.

The tilting disks of the storage feeding units 16*ab* to 16*ad* illustrated in FIG. 4 are rotated in the direction same as the direction of the tilting disk 16*aaa* of the storage feeding unit 16*aa* described with reference to FIG. 3. The tilting disks of the storage feeding units 16*bb* to 16*bd* illustrated in FIG. 4 are rotated in the direction same as the direction of the tilting disk baa of the storage feeding unit 16*ba* described with reference to FIG. 3. In other words, the rotating direction of the tilting disks of the right storage feeding units 16*aa* to 16*ad* and the rotating direction of the tilting disks of the left storage feeding units 16*ba* to 16*bd* are opposite to each other.

Next, schematic operation of the coin handling apparatus 1 is described with reference to FIG. 2. The depositing operation is first described.

The coins put into the inlet 2 are reserved in the hopper of the reservation feeding unit 11. The coins reserved in the hopper of the reservation feeding unit 11 are picked up by the tilting disk 11*a*, and are fed out to the transport unit 12.

The coins fed out to the transport unit 12 are recognized by the recognition unit 13. In a case where the recognized coins are not rejected coins, the coins are diverted by the coin diverters 15*a* to 15*d*, and are stored in any of the storage feeding units 16*aa* to 16*ad* and 16*ba* to 16*bd*.

In a case where the recognized coins are rejected coins, the rejected coins are diverted by the coin diverter 14 to the dispensing transport unit 17, and fall onto the dispensing transport unit 17. The rejected coins fallen onto the dispensing transport unit 17 are temporarily stored on the dispensing transport unit 17. In other words, the dispensing transport unit 17 functions as a temporary storage section that temporarily stores the rejected coins. At this time, the first stopper 25 and the second stopper 26 prevent the coins from being discharged from the collection section 20 and the outlet 3.

After all of the coins reserved in the reservation feeding unit 11 are fed out, the dispensing transport unit 17 transports the rejected coins temporarily stored on the dispensing transport unit 17, toward the collection section 20 or the outlet 3.

In a case where the rejected coins temporarily stored on the dispensing transport unit 17 are counterfeit coins or possible counterfeit coins, the dispensing transport unit 17 transports the coins to the collection section 20. At this time, the first stopper 25 is rotated rearward. As a result, the coins recognized as the counterfeit coins or as possible counterfeit coins by the recognition unit 13 are ejected to the collection section 20.

In a case where the coins temporarily stored in the dispensing transport unit 17 are rejected coins other than the counterfeit coins and the possible counterfeit coins recognized by the recognition unit 13, namely, in a case where the rejected coins temporarily stored on the dispensing transport unit 17 do not include the counterfeit coin and the possible counterfeit coin, the dispensing transport unit 17 transports all of the coins toward the outlet 3. At this time, the second stopper 26 is rotated forward. As a result, the rejected coins other than the counterfeit coin and the possible counterfeit coins recognized by the recognition unit 13 are ejected to the outlet 3.

When ejection of the coins to the collection section 20 is completed, the first stopper 25 is rotated toward the original position. Further, when the ejection of the coins to the outlet 3 is completed, the second stopper 26 is rotated toward the original position.

Note that, in a case where the rejected coins temporarily stored on the dispensing transport unit 17 include the counterfeit coins or the possible counterfeit coins and the other coins, the dispensing transport unit 17 ejects all of the temporarily-stored coins to the collection section 20.

The coin handling apparatus 1 may comprise a notification section that notifies ejection of the coins to the collection section 20 when the dispensing transport unit 17 ejects the coins to the collection section 20. The notification section notifies ejection of the counterfeit coins or the possible counterfeit coins to the collection section 20 through, for example, output of sound, lighting of a lamp, and output to a display apparatus. This enables the attendant to know ejection, to the collection section 20, of the counterfeit coins or the possible counterfeit coins.

In addition, the notification section may notify ejection of the coins to the outlet 3 when the dispensing transport unit 17 ejects, to the outlet 3, the rejected coins other than the counterfeit coins and the possible counterfeit coins. This enables the customer to know ejection, to the outlet 3, of the rejected coins other than the counterfeit coins and the possible counterfeit coins.

Next, the dispensing operation is described. When the coins are dispensed from the coin handling apparatus 1, the coins are fed out from the storage feeding units 16*aa* to 16*ad* and 16*ba* to 16*bd*. The coins stored in the storage feeding units 16*aa* to 16*ad* and 16*ba* to 16*bd* are picked up by the tilting disks provided in the respective storage feeding units 16*aa* to 16*ad* and 16*ba* to 16*bd*. The picked-up coins are guided to the feeding outlets through the guide G1 (see. FIG. 3), and fall onto the dispensing transport unit 17.

The dispensing transport unit 17 transports the coins fallen onto the dispensing transport unit 17 toward the outlet 3. At this time, the second stopper 26 is rotated forward. As a result, the coins fed out from the storage feeding units 16*aa* to 16*ad* and 16*ba* to 16*bd* are ejected to the outlet 3. When the ejection of the coins to the outlet 3 is completed, the second stopper 26 is rotated toward the original position.

Note that, in a case where the coins stored in any or all of the storage feeding units 16*aa* to 16*ad* and 16*ba* to 16*bd* in the coin handling apparatus 1 are collected by the attendant, the coins fed out from the storage feeding units 16*aa* to 16*ad* and 16*ba* to 16*bd* are ejected from the dispensing transport unit 17 to the collection section 20.

As described above, the coin handling apparatus 1 according to the present embodiment can eject the coins recognized as the counterfeit coins or the possible counterfeit coins by the recognition unit 13, to the collection section 20. This makes it possible to prevent these coins from being put into circulation again. On the other hand, the coin handling apparatus 1 ejects, to the outlet 3, the rejected coins other than the coins recognized as the counterfeit coin or the possible counterfeit coins by the recognition unit 13. Accordingly, the coin handling apparatus 1 can return the coins to be returned to the customer, to the customer.

Note that, in the above-described embodiment, the rejected coins are temporarily stored on the dispensing transport unit 17, and the temporarily-stored rejected coins are collectively transported to the collection section 20 or the outlet 3. Alternatively, a transport unit that transports the rejected coins diverted by the coin diverter 14 one by one to the collection section 20 or the outlet 3 may be provided in place of the above-described dispensing transport unit 17. This makes it possible to eject the counterfeit coins and the possible counterfeit coins to the collection section 20 and to eject the other rejected coins to the outlet 3 even in a case where the coins recognized by the recognition unit 13 include the counterfeit coins or the possible counterfeit coins and the other rejected coins.

Further, in the above-described embodiment, the collection section 20 is provided outside the coin handling apparatus 1; however, the configuration is not limited thereto, and the collection section 20 may be housed inside the housing of the coin handling apparatus 1 and may be drawn out rearward from the housing at the time of collection.

Further, the counterfeit coins and the possible counterfeit coins may be stored in the storage unit 18.

Next, an inventory amount reference function of the coin handling apparatus 1 is described. The coin handling apparatus 1 comprises the inventory amount reference function that allows the attendant to refer to an inventory amount of the coins stored inside the coin handling apparatus 1. An operation display (not illustrated) such as a touch panel is connected to the coin handling apparatus 1. In response to operation to execute the inventory amount reference function being performed on the operation display, the coin handling apparatus 1 displays the inventory amount on the operation display.

Further, the coin handling apparatus 1 is connected to a server apparatus through a network. Information on the number of coins and an amount deposited to the coin handling apparatus 1, information on the number of coins and an amount dispensed from the coin handling apparatus 1, and information on the inventory amount of the coins stored inside the coin handling apparatus 1 are transmitted to the server apparatus and are stored in a memory of the server apparatus.

In a case where the operation to execute the inventory amount reference function is performed on the operation display, information indicating execution of the inventory amount reference function is transmitted to the server apparatus. The information indicating execution of the inventory amount reference function is, for example, information on a time when the operation to execute the inventory amount reference function is performed.

Upon receipt of the information indicating execution of the inventory amount reference function, the server apparatus stores the information in the memory. Further, the server apparatus stores the number of reception times of the information. In a case where the number of reception times of the information indicating execution of the inventory amount reference function exceeds a predetermined number of times, the server apparatus notifies that the number of execution times of the inventory amount reference function exceeds the predetermined number of times, to an administrator terminal of the coin handling apparatus 1 and the operation display.

The server apparatus displays alert information, for example, "The inventory amount reference function has been used twice today. Usage of the inventory amount reference function is prohibited with one more execution.", on the administrator terminal and the operation display.

The server apparatus displays such alert information on the operation display, which makes it possible to prevent the inventory amount reference function from being excessively used in the store in which the coin handling apparatus 1 is installed. Further, the server apparatus causes the administrator terminal to perform such a display, which enables an administrator to grasp presence/absence of the coin handling apparatus 1, the inventory amount reference function of which has been used plurality of times, and to grasp the coin handling apparatus 1 in which the inventory amount reference function is used many times.

In a case where the inventory amount reference function is used after the alert information is displayed, the server apparatus prohibits usage of the inventory amount reference function of the coin handling apparatus 1. This makes it possible to prevent the inventory amount reference function from being excessively used in the coin handling apparatus 1.

Although the coin handling apparatus 1 has been described in the above-described embodiment, the technology described in the present embodiment is applicable to a banknote handling apparatus. More specifically, the banknote handling apparatus comprises an inlet section that is provided on customer side of the banknote handling apparatus and from which banknotes are put in, a recognition unit that recognizes the banknotes put in from the inlet section, and a first ejection section that is provided on attendant side of the banknote handling apparatus and to which banknotes recognized as rejected banknotes by the recognition unit are ejected.

In the above-described banknote handling apparatus, among the banknotes recognized as the rejected banknotes by the recognition unit, banknotes recognized as counterfeit notes are ejected to the first ejection section.

In the above-described banknote handling apparatus, the first ejection section is provided at a position inaccessible from the customer side.

The above-described banknote handling apparatus further comprises a temporary storage section that temporarily stores the banknotes recognized as the rejected banknotes by the recognition unit. In a case where the banknotes stored in the temporary storage section include the banknotes recognized as the counterfeit notes by the recognition unit, the banknotes stored in the temporary storage section are ejected to the first ejection section.

The above-described banknote handling apparatus further comprises a second ejection section that is provided on the customer side and to which the banknotes are ejected.

The above-described banknote handling apparatus further comprises a transport unit that transports the banknotes. The banknotes stored in the temporary storage section are transported to the first ejection section or the second ejection section by the transport unit.

The above-described banknote handling apparatus further comprises a feeding unit that feeds out the banknotes, and the banknotes fed out by the feeding unit are ejected to the second ejection section.

In the above-described banknote handling apparatus, the banknotes fed out from the feeding unit are change, changed banknotes, or dispended banknotes.

The above-described banknote handling apparatus further comprises a notification section that notifies ejection of the banknotes to the first ejection section.

In the above-described banknote handling apparatus, the notification section notifies ejection of the banknotes in different manners depending on an ejection destination of the banknotes.

Moreover, the present invention is not limited to the coin handling apparatus 1 and the banknote handling apparatus, and may be a money handling apparatus. More specifically, the money handling apparatus comprises an inlet section that is provided on customer side of the money handling apparatus and from which money is put in, a recognition unit that recognizes the money put in from the throw-in unit, and a first ejection section that is provided on attendant side of the money handling apparatus and to which money recognized as rejected money by the recognition unit is ejected.

In the above-described money handling apparatus, among the money recognized as the rejected money by the recognition unit, money recognized as counterfeit money or possible counterfeit money is ejected to the first ejection section.

In the above-described money handling apparatus, the first ejection section is provided at a position inaccessible from the customer side.

The above-described money handling apparatus further comprises a temporary storage section that temporarily stores the money recognized as the rejected money by the recognition unit. In a case where the money stored in the temporary storage section includes the money recognized as the counterfeit money by the recognition unit, the money stored in the temporary storage section is ejected to the first ejection section.

The above-described money handling apparatus further comprises a second ejection section that is provided on the customer side and to which the money is ejected.

The above-described money handling apparatus further comprises a transport unit that transports the money. The money stored in the temporary storage section is transported to the first ejection section or the second ejection section by the transport unit.

The above-described money handling apparatus further comprises a feeding unit that feeds out the money, and the money fed out by the feeding unit is ejected to the second ejection section.

In the above-described money handling apparatus, the money fed out from the feeding unit is change, changed money, or dispended money.

The above-described money handling apparatus further comprises a notification section that notifies ejection of the money to the first ejection section.

In the above-described money handling apparatus, the notification section notifies ejection of the money in different manners depending on an ejection destination of the money.

Moreover, the above-described money handling apparatus may be the following money handling apparatus. A money handling apparatus handles money, and comprises an inlet section from which the money is put in, a recognition unit that recognizes the money put in from the inlet section, a transport unit that transports the money recognized by the recognition unit, and a control unit that controls the transport unit to sort, among the money recognized as rejected money by the recognition unit, the money recognized as counterfeit money or as possible counterfeit money, and the money other than the money recognized as the counterfeit money and the possible counterfeit money.

Further, the above-described money handling apparatus may be the following money handling apparatus. A money handling apparatus handles money, and comprises an inlet section from which the money is put in, a recognition unit that recognizes the money put in from the inlet section, a transport unit that transports the money recognized by the recognition unit, a temporary storage section that temporarily stores the money recognized as rejected money by the recognition unit, and a control unit that controls the transport unit to transport the money stored in the temporary storage section to a transport destination different between a case where the money stored in the temporary storage section includes money recognized as counterfeit money or possible counterfeit money by the recognition unit and a case where the money stored in the temporary storage section does not include money recognized as counterfeit money and possible counterfeit money by the recognition unit.

INDUSTRIAL APPLICABILITY

The present invention is widely usable in the coin handling apparatus and the coin handling method.

REFERENCE SIGNS LIST

1 Coin handling apparatus
2 Inlet
3 Outlet
11 Reservation feeding unit
11*a* Tilting disk
12 Transport unit
13 Recognition unit
14, 15*a*, 15*b*, 15*c*, 15*d* Coin diverter
16*aa*, 16*ab*, 16*ac*, 16*ad*, 16*ba*, 16*bb*, 16*bc*, 16*bd* Storage feeding unit
16*aaa*, 16*baa* Tilting disk
17 Dispensing transport unit
18 Storage unit
20 Collection section
25 First stopper
26 Second stopper
G1 Guide

The invention claimed is:

1. A coin handling apparatus that handles a coin, the coin handling apparatus comprising:

an inlet section that is provided on a customer side of the coin handling apparatus and from which the coin is put in;

a recognition unit that recognizes the coin put in from the inlet section; and a first ejection section that is provided on an attendant side of the coin handling apparatus and to which the coin recognized as a rejected coin by the recognition unit is ejected, wherein the first ejection section is provided at a position inaccessible from the customer side.

2. The coin handling apparatus according to claim 1, wherein the coin recognized as a counterfeit coin and the coin recognized as a possible counterfeit coin are ejected to the first ejection section among the coins recognized as the rejected coins by the recognition unit.

3. The coin handling apparatus according to claim 1, further comprising a notification section that notifies ejection of the coin to the first ejection section.

4. The coin handling apparatus according to claim 3, wherein the notification section notifies ejection of the coin in a different manner depending on an ejection destination of the coin.

5. A coin handling apparatus that handles a coin, the coin handling apparatus comprising:

an inlet section that is provided on a customer side of the coin handling apparatus and from which the coin is put in;

a recognition unit that recognizes the coin put in from the inlet section;

a first ejection section that is provided on an attendant side of the coin handling apparatus and to which the coin recognized as a rejected coin by the recognition unit is ejected;

a temporary storage section that temporarily stores the coin recognized as the rejected coin by the recognition unit; and a second ejection section that is provided on the customer side and to which the coin is ejected, wherein in a case where the coins stored in the temporary storage section comprise the coin recognized as a counterfeit coin by the recognition unit, the coins stored in the temporary storage section are ejected to the first ejection section or the second ejection section.

6. The coin handling apparatus according to claim 5, wherein the temporary storage section comprises a stopper that prevents the coin from being discharged from the temporary storage section to the first ejection section or the second ejection section.

7. The coin handling apparatus according to claim 6, wherein the stopper comprises a first stopper and a second stopper, the first stopper preventing the coin from being discharged to the first ejection section, and the second stopper preventing the coin from being discharged to the second ejection section.

8. The coin handling apparatus according to claim 7, wherein, in a case where any one of the first stopper and the second stopper is put into a state of preventing the coin from being discharged, the other stopper is put into a state of not preventing the coin from being discharged.

9. The coin handling apparatus according to claim 5, further comprising a feeding unit that feeds out the coin, wherein the coin fed out by the feeding unit is ejected to the second ejection section.

10. The coin handling apparatus according to claim 9, wherein the coin fed out by the feeding unit is change, a changed coin, or dispensed coin.

* * * * *